US008528695B1

(12) United States Patent
Orpia

(10) Patent No.: US 8,528,695 B1
(45) Date of Patent: Sep. 10, 2013

(54) LADDER SAFETY SYSTEMS

(76) Inventor: Franklin M. Orpia, Sheridan, CA (US)

( * ) Notice: Subject to any disclaimer, the term of this patent is extended or adjusted under 35 U.S.C. 154(b) by 0 days.

(21) Appl. No.: 13/346,363

(22) Filed: Jan. 9, 2012

Related U.S. Application Data

(60) Provisional application No. 61/436,520, filed on Jan. 26, 2011.

(51) Int. Cl.
*E06C 1/34* (2006.01)
*E06C 7/48* (2006.01)

(52) U.S. Cl.
USPC ..... 182/107; 182/206

(58) Field of Classification Search
USPC ..... 182/107, 206, 214
See application file for complete search history.

(56) References Cited

U.S. PATENT DOCUMENTS

| | | | | |
|---|---|---|---|---|
| 1,393,922 | A * | 10/1921 | Taylor | 182/214 |
| 3,037,579 | A * | 6/1962 | Barrow | 182/107 |
| 3,715,012 | A | 2/1973 | Perry | |
| 3,792,756 | A | 2/1974 | Kelly | |
| 4,280,590 | A * | 7/1981 | Polizzi | 182/214 |
| 4,469,195 | A | 9/1984 | Sartain | |
| 4,742,888 | A | 5/1988 | Amacker | |
| 4,995,476 | A | 2/1991 | Buck | |
| 5,373,913 | A | 12/1994 | Santos | |
| 5,460,240 | A | 10/1995 | Jones | |
| 5,622,238 | A | 4/1997 | Farmer | |
| 5,638,916 | A | 6/1997 | Schneider | |
| 5,664,643 | A | 9/1997 | Taylor, Jr. | |
| 5,775,465 | A | 7/1998 | Vossler | |
| 5,941,343 | A | 8/1999 | Kelsey | |
| 6,244,382 | B1 | 6/2001 | Labonte | |
| 6,698,546 | B1 | 3/2004 | Sandor, Sr. | |
| 6,729,441 | B1 | 5/2004 | Nahlen | |
| 7,575,097 | B2 | 8/2009 | Sheridan et al. | |
| 2002/0108811 | A1 | 8/2002 | Ulmschneider et al. | |
| 2002/0134619 | A1 * | 9/2002 | Schwenke | 182/107 |
| 2004/0216955 | A1 | 11/2004 | Unger | |
| 2009/0242328 | A1 | 10/2009 | Cabrera et al. | |

* cited by examiner

*Primary Examiner* — Katherine Mitchell
*Assistant Examiner* — Kristine Florio
(74) *Attorney, Agent, or Firm* — Stoneman Law Patent Group; Martin L. Stoneman

(57) ABSTRACT

A ladder apparatus and system relating to detachably securing a ladder to linear, or non-linear, structures such as, for example, a tree, a telephone pole, a building pillar, etc., thereby assisting preventing the ladder from lateral movement. The system provides for width, depth and angle adjustment to assist clasping to different structural support geometries being attached thereto.

20 Claims, 10 Drawing Sheets

LADDER SAFETY SYSTEMS

CROSS-REFERENCE TO RELATED APPLICATION

The present application is related to and claims priority from prior provisional application Ser. No. 61/436,520, filed Jan. 26, 2011, entitled "LADDER SAFETY SYSTEMS", the contents of all of which are incorporated herein by this reference and are not admitted to be prior art with respect to the present invention by the mention in this cross-reference section.

BACKGROUND

This invention relates to providing a system for improved ladder safety systems. More particularly, this invention relates to providing a system for detachably securing at least one ladder to structures comprising at least one elevated support, such as, for example, a tree, a telephone pole, a building pillar, etc., thereby preventing the ladder from slipping and falling.

Many ladders, particularly of the extension ladder type, are simply leaned against stationary objects for support. Such a leaning arrangement is unstable and prone to ladder slippage, particularly when a user climbs the ladder or stands on the ladder rungs and applies downward, or sideways, forces on the ladder.

Potential for ladder slippage and accidents is even greater when the support comprises some degree of surface non-uniformity or curvature, for example, when a ladder is positioned (leaned) against a bent tree. In order to prevent accidents resulting from ladder slippage, systems are needed which are designed to more safely secure ladders and accommodate support surface non-uniformity.

OBJECTS AND FEATURES OF THE INVENTION

A primary object and feature of the present invention is to provide a system overcoming the above-mentioned problem(s).

It is a further object and feature of the present invention to provide such a system for detachably securing ladders to supports, particularly angled, upright and/or horizontal supports.

Another object and feature of the present invention is to provide such a system comprising at least one clasping mechanism to assist detachably securing a ladder to a support structure.

Another object and feature of the present invention is to provide such a system comprising adjustable clasps capable of accommodating variable widths and thicknesses of upright support structures.

Another object and feature of the present invention is to provide such a system comprising at least one angle accommodator to adapt to, and assist securing to, variable angles of structural supports used to support a ladder.

Another object and feature of the present invention is to provide such a system comprising at least one clamping feature to assist detachably securing a ladder to a support structure.

Yet another object and feature of the present invention is to provide such a system comprising a user-adjustable means to accommodate unusual surfaces and/or curvature in the upright support structure, without compromising system security or stability.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to securing at least one ladder, having at least one ladder rung, to at least one elevated structural support, comprising: at least one ladder rung mount structured and arranged to mount to the at least one ladder rung; at least one support engager structured and arranged to engage to the at least one elevated structural support; wherein such at least one support engager comprises at least one clasper structured and arranged to clasp to the at least one elevated structural support; wherein such at least one support engager comprises at least one width accommodator structured and arranged to accommodate variable widths of the at least one elevated structural support; wherein such at least one support engager comprises at least one depth accommodator structured and arranged to accommodate variable depths of the at least one elevated structural support; and wherein such at least one support engager comprises at least one angle accommodator structured and arranged to accommodate a plurality of angle geometries of the at least one elevated structural support; and whereby the at least one ladder may be secured to elevated structural supports comprising a plurality of differing width, depth and angular geometries.

Moreover, it provides such a system, wherein: the at least one ladder rung comprises at least one bottom portion and at least one upper foot-placement portion; such at least one ladder rung mount comprises at least one rung engager structured and arranged to engage such at least one bottom portion of the at least one ladder rung; at least one rung cover structured and arranged to cover such at least one upper foot-placement portion; and at least one coupler structured and arranged to couple such at least one rung engager to such at least one rung cover; wherein such at least one rung engager and such at least one rung cover each comprise at least one receiver structured and arranged to receive such at least one coupler; and at least one connector structured and arranged to connect such at least one ladder rung mount to such at least one support engager. Additionally, it provides such a system, wherein such at least one rung engager and such at least one connector may be oriented from about a zero-degree to about a 90-degree angle with respect to one another.

Also, it provides such a system, wherein such at least one connector further comprises: such at least one angle accommodator; and at least one rotator structured and arranged to rotate such at least one support engager with respect to such at least one ladder rung mount; wherein such at least one rotator comprises at least one pivot structured and arranged to assist pivoting such at least one support engager with respect to such at least one ladder rung mount; and wherein such at least one rotator comprises at least one restrictor structured and arranged to restrict the maximal angular displacement between such at least one support engager and such at least one ladder rung mount; and at least one fixer structured and arranged to assist fixing the angle of rotation of such at least one support engager with respect to such at least one ladder rung mount.

In addition, it provides such a system, wherein such at least one width accommodator comprises: at least one guide structured and arranged to guide the lateral movement of such at least one width accommodator; at least one adjustable fixer structured and arranged to assist adjustably fixing such lateral movement; and wherein such width of such at least one width accommodator may be adjustably fixed. And, it provides such a system, wherein such at least one width accommodator limits range of widths of such at least one support engager from about two hundred millimeters to about three hundred millimeters. Further, it provides such a system, wherein such at least one depth accommodator comprises: at least one guide structured and arranged to guide the lateral movement of such at least one depth accommodator; at least one adjustable fixer structured and arranged to assist adjustably fixing such lateral movement; wherein such depth of such at least one depth accommodator may be adjustably fixed. Even further, it provides such a system, wherein such at least one angle accommodator comprises: at least one coupler structured and arranged to couple to such at least one connector; at least one rotator structured and arranged to rotate such at least one support engager with respect to such at least one ladder rung mount; wherein such at least one rotator comprises at least one pivot structured and arranged to assist pivoting such at least one support engager with respect to such at least one ladder rung mount; wherein such at least one rotator comprises at least one restrictor structured and arranged to restrict the maximal angular displacement between such at least one support engager and such ladder rung mount; and at least one adjustable fixer structured and arranged to assist adjustably fixing the angle of rotation of such at least one support engager with respect to such at least one ladder rung mount.

Moreover, it provides such a system, wherein such at least one support engager comprises at least one strap structured and arranged to assist strapping such at least one support engager to the at least one elevated structural support. Additionally, it provides such a system, wherein such at least one rung cover comprises at least one hinge structured and arranged to hinge such at least one rung cover to such at least one rung engager. Also, it provides such a system, wherein such at least one restrictor restricts the maximal angular displacement between such at least one support engager and such at least one ladder rung mount from about zero-degrees to about 90-degrees.

In accordance with another preferred embodiment hereof, this invention provides a system, relating to securing at least one ladder to at least one elevated structural support, comprising: at least one ladder rung mount structured and arranged to mount to at least one ladder rung; at least one support engager structured and arranged to engage to such at least one elevated structural support; wherein such at least one support engager comprises at least one clamp structured and arranged to clamp to the at least one elevated structural support; wherein such at least one support engager comprises at least one width accommodator structured and arranged to accommodate variable widths of the at least one elevated structural support; wherein such at least one support engager comprises at least one depth accommodator structured and arranged to accommodate variable depths of the at least one elevated structural support; wherein such at least one support engager comprises at least one rotator structured and arranged to rotate such at least one support engager with respect to such at least one ladder rung mount; wherein the at least one ladder may be clamped to a plurality of width, depth and angular geometries of the at least one elevated structural support.

In addition, it provides such a system, wherein such at least one curve accommodator comprises: at least one rotator structured and arranged to rotate such at least one support engager with respect to such at least one ladder rung mount; wherein such at least one rotator comprises at least one pivot structured and arranged to assist pivoting such at least one support engager with respect to such at least one ladder rung mount; wherein such at least one rotator comprises at least one restrictor structured and arranged to restrict the maximal angular displacement between such at least one support engager and such ladder rung mount; wherein such at least one restrictor restricts the maximal angular displacement between such at least one support engager and such at least one ladder rung mount from about 0-degrees to about 270-degrees; and at least one adjustable fixer structured and arranged to assist adjustably fixing the angle of rotation of such at least one support engager with respect to such at least one ladder rung mount.

In accordance with another preferred embodiment hereof, this invention provides a system, relating to securing at least one ladder, having at least one ladder rung, to at least one upward extending support, comprising: ladder rung mount means for mounting to at least one ladder rung; support engager means for engaging to the at least one upward extending support; wherein such support engager means comprises clasping means for clasping to the at least one upward extending support; wherein such support engager means comprises width accommodator means for accommodating variable widths of the at least one upward extending support; wherein such support engager means comprises depth accommodator means for accommodating variable depths of the at least one upward extending support; and wherein such support engager means comprises angle accommodator means for accommodating variable angles of the at least one upward extending support; wherein the at least one ladder may be clasped to a plurality of angular geometries of the at least one elevated structural support.

And, it provides such a system, wherein such ladder rung mount means comprises: rung engager means for engaging the bottom surface of at least one ladder rung; rung cover means for covering the top surface of such at least one ladder rung; coupler means for coupling such rung engager means to such rung cover means; wherein such rung engager means and such rung cover means each comprise receiver means for receiving such fastener means; and connector means for connecting to such support engager means. Further, it provides such a system, wherein such rung engager means and such connector means are oriented at a 90° angle with respect to one another. Even further, it provides such a system, wherein such connector means further comprises: angle accommodator means for accommodating variable angles of such at least one upward extending support; rotator means for rotating such support engager means with respect to such ladder rung mount means; wherein such rotator means comprises pivot means for pivoting such support engager means with respect to such ladder rung mount means; wherein such rotator means comprises restrictor means for restricting the maximal angular displacement between such support engager means and such ladder rung mount means to about 90'; and fixer means for fixing the angle of rotation of such support engager means with respect to such ladder rung mount means. Even further, it provides such a system, wherein such width accommodator means comprises: guide means for guiding the lateral movement of such clamp means; wherein such guide means comprises restrictor means for restricting the up and down movement of such clamp means; and adjustable fixer means for adjustably fixing the width of such support engager means.

Even further, it provides such a system, wherein such width accommodator limits range of widths of such support engager means from about two hundred millimeters to about three hundred millimeters. Even further, it provides such a system, wherein such depth accommodator comprises: guide means for guiding the lateral movement of such clamp means; wherein such guide means comprises restrictor means for restricting the up and down movement of such clamp means; adjustable fixer means for adjustably fixing the depth of such support engager means. Even further, it provides such a system, wherein such angle accommodator means comprises: coupler means for coupling to such connector means; rotator means for rotating such support engager means with respect to such ladder rung mount means; wherein such rotator means comprises pivot means for pivoting such support engager means with respect to such ladder rung engager means; wherein such rotator means comprises restrictor means for restricting the maximal angular displacement between such support engager means and such ladder rung mount means to from about 0-degrees to about 270-degrees; and adjustable fixer means for adjustably fixing the angle of rotation of such support engager means with respect to such ladder rung mount means.

Even further, it provides such a system, wherein such support engager means comprises strap means for strapping such support engager means to such at least one upward extending support.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

This invention relates to providing a system for securing at least one ladder to at least one support structure by an adjustable clasping mechanism which is capable of accommodating variable dimensions of a support. More particularly, this invention relates to providing a system to secure at least one ladder to a support, even when the support deviates from linearity.

Figure 1:
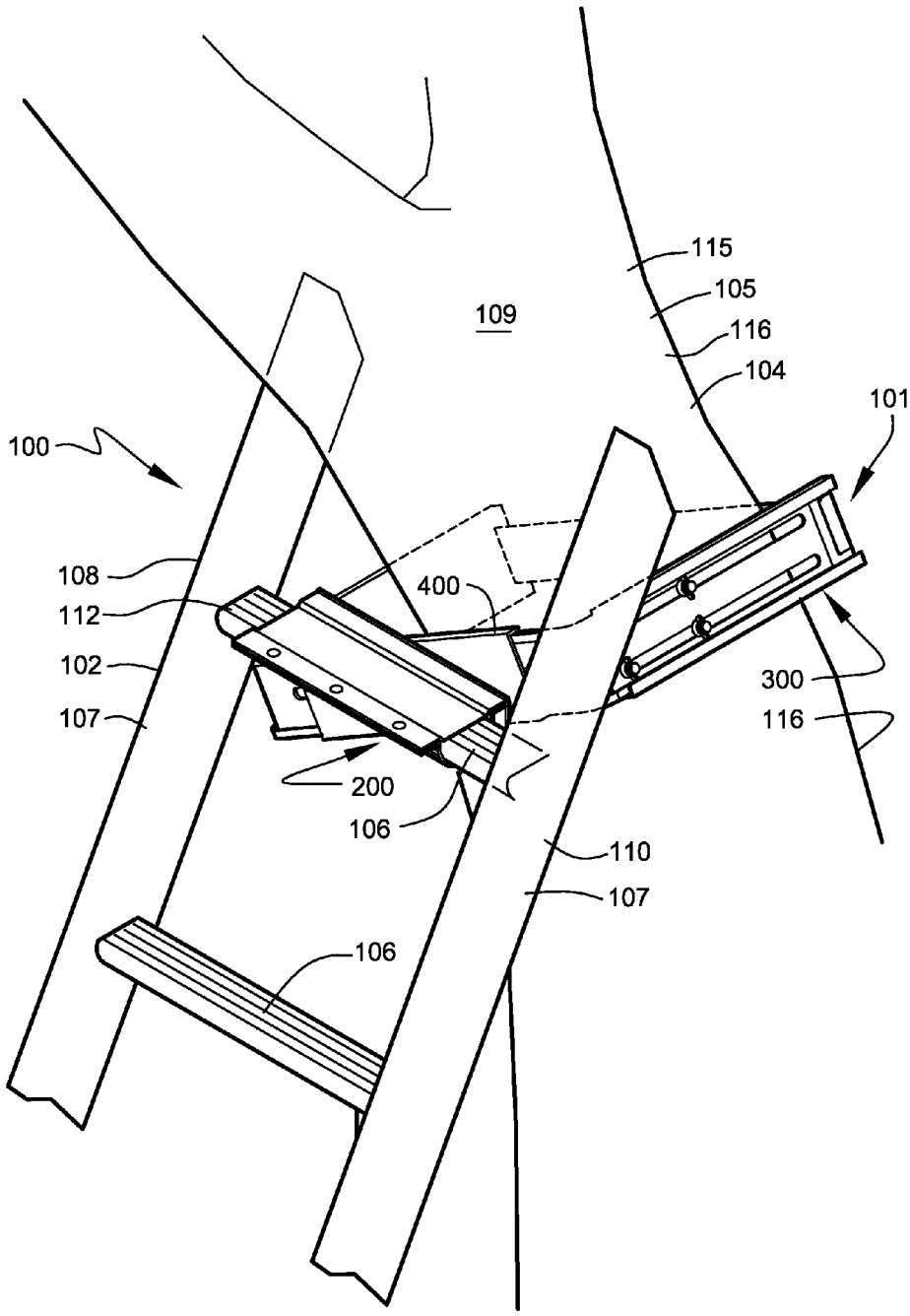
FIG. 1 shows a perspective view, illustrating a preferred use of the ladder safety device of the ladder safety system, according to a preferred embodiment of the present invention.
Figure 2:
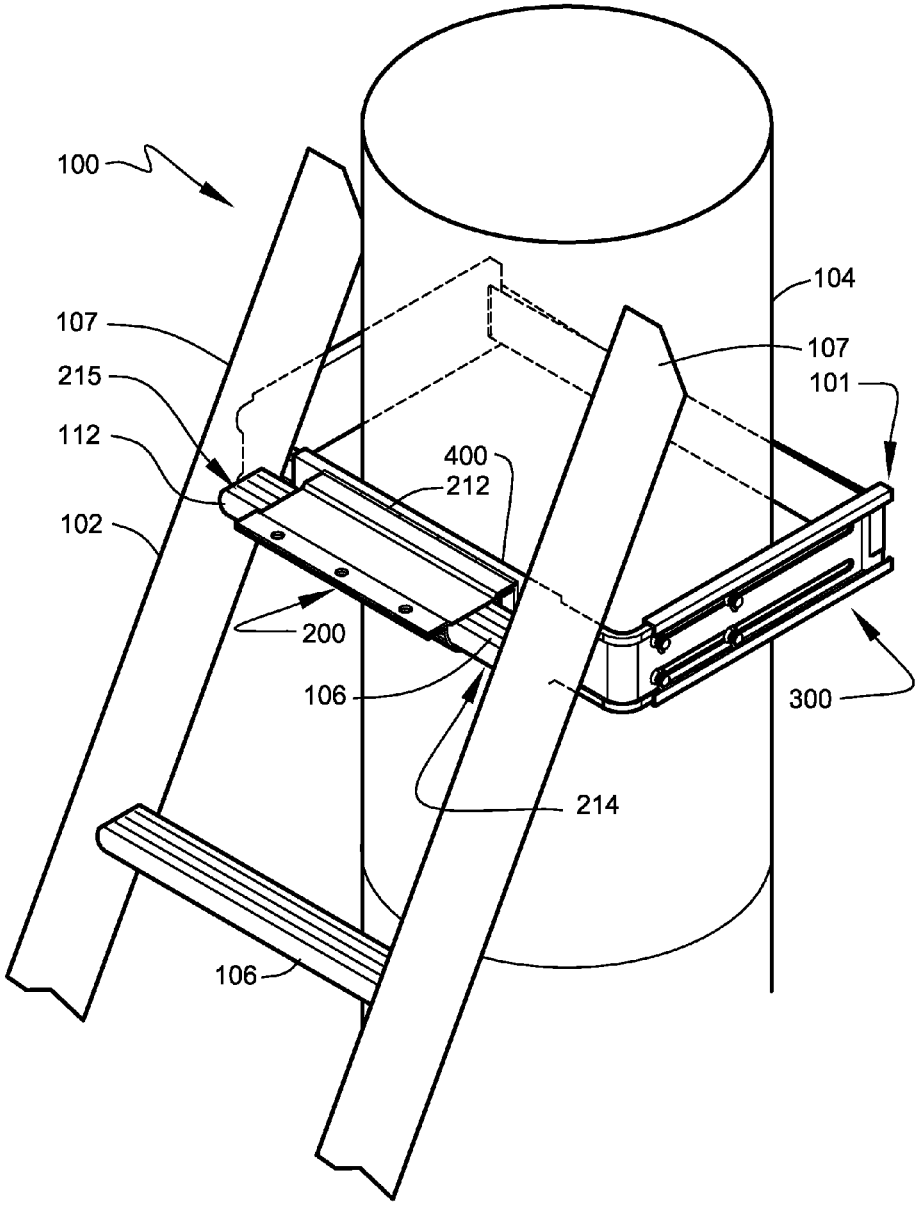
FIG. 2 shows a perspective view, illustrating another preferred use of the ladder safety device of the ladder safety system, according to the preferred embodiment of FIG. 1.

FIG. 1 shows a perspective view, illustrating a preferred use of ladder safety device 101 of ladder safety system 100, according to a preferred embodiment of the present invention. FIG. 2 shows a perspective view, illustrating another preferred use of ladder safety device 101 of ladder safety system 100, according to a preferred embodiment of the present invention.

Ladder safety device 101 preferably is utilized to assist securing at least one ladder 102 to a structure 105, preferably having at least one support member 104, preferably upright, which may comprise, for example, a tree, a pole, a building pillar, etc., as shown. Upon reading this specification, those with ordinary skill in the art will now appreciate that, under appropriate circumstances, considering such issues as building structure, user preferences, marketing preferences, cost, structural requirements, available materials, technological advances, etc., other structural use arrangements such as, for example, ladder support by a horizontal beam, ladder support by a cross-member structural support, assisted ladder securing on other structures or materials, etc., may suffice.

Preferably, ladder safety device 101 is attachable to a ladder 102 to assist preventing ladder slippage after placement against a structural member, as well as, fall accidents related to ladder movement; preferably, by assisting to firmly secure the ladder to the chosen structural member (when so attached). Ladder 102, preferably is of the extension ladder type, preferably comprising a plurality of rungs 106 attached between at least two rails 107 preferably comprising at least one left rail 108 and at least one right rail 110, as shown (in FIG. 1). Upon reading this specification, those with ordinary skill in the art will now appreciate that, under appropriate circumstances, considering such issues as design preference, user preferences, marketing preferences, cost, structural requirements, available materials, technological advances, etc., other ladder rail arrangements such as, for example, double-rails, triple rails (which may occur with use of certain types of long extension ladders), etc., may suffice.

Ladder safety device 101 preferably engages at least one of rungs 106, preferably top rung 112, as shown. Ladder safety device 101 preferably at least clasps the outer periphery 109 of support member 104, alternately preferably clamping to support member 104, thereby preferably anchoring ladder 102, preferably rigidly, to support member 104. Ladder safety device 101 preferably assists securing ladder 102 to both a straight support as well as a bent upright support 116, which may comprise, for example, a bent tree, as shown.

Ladder safety device 101 preferably is adjustable by at least one user in either and/or both width and depth to clasp tree 115 (bent upright support 116); and, may also be adjusted to accommodate the curvature of such tree 115 (bent upright support 116), as shown. As illustrated, ladder safety device 101 sufficiently assists a user to secure ladder safety device 101 so as to preferably allow at least one user to at least vertically climb or stand on ladder 102, as shown.

Figure 3A:
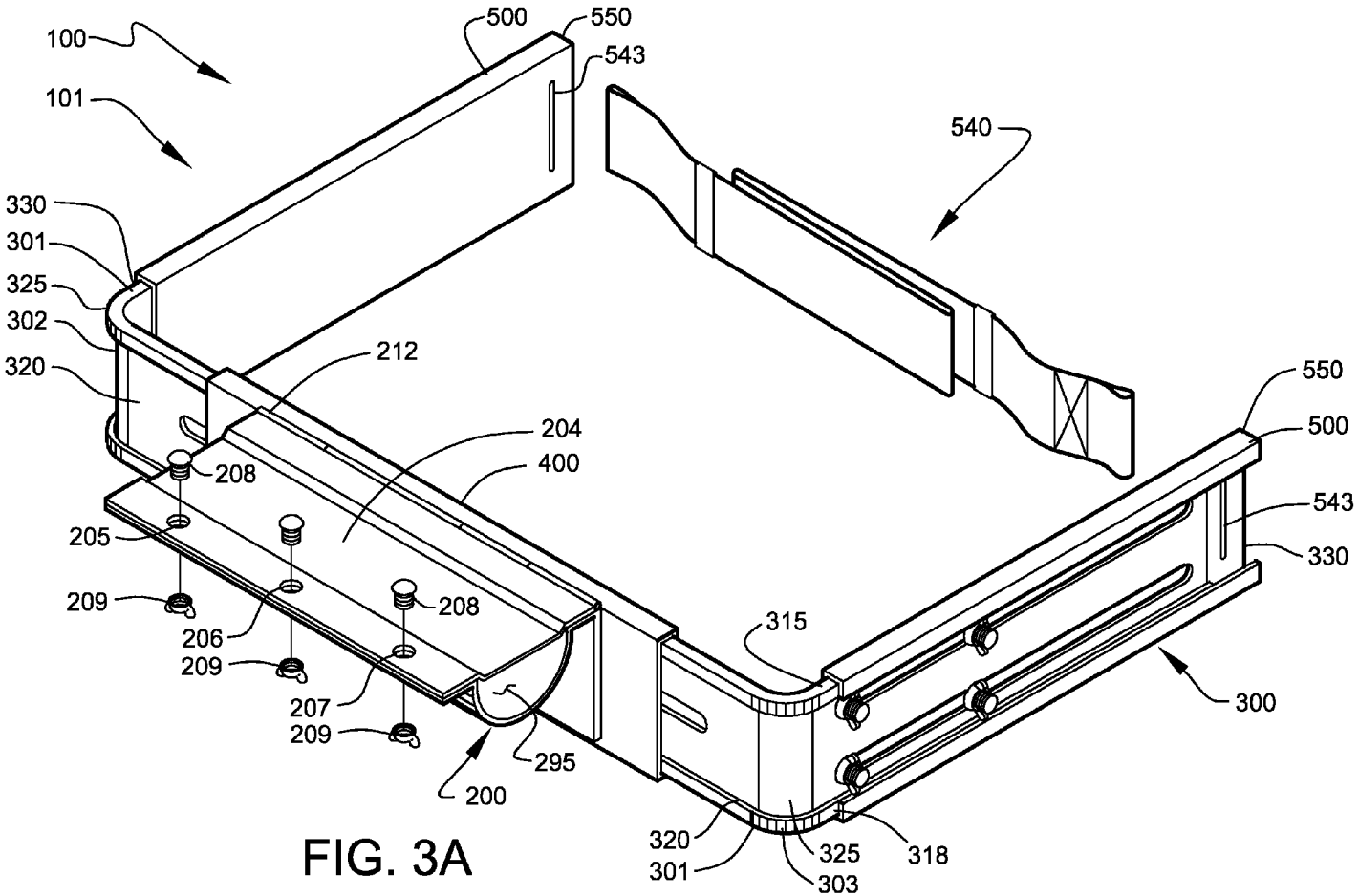
FIG. 3A shows an isometric view, illustrating a fully assembled ladder safety device of the ladder safety system, according to the preferred embodiment of FIG. 1.
Figure 3B:
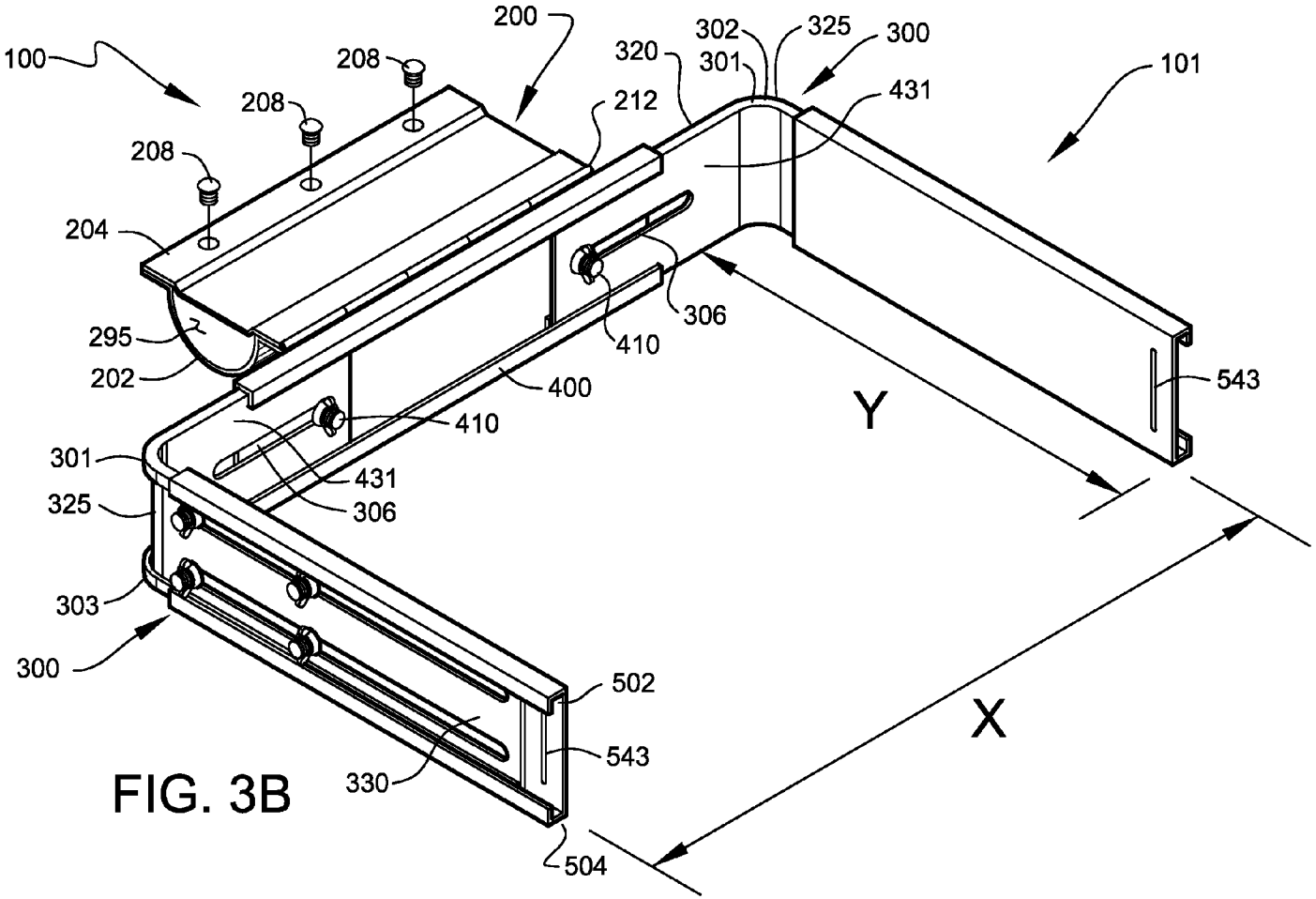
FIG. 3B shows another isometric view, illustrating the opposing view of the fully assembled ladder safety device of the ladder safety system, according to the preferred embodiment of FIG. 3A.

FIG. 3A shows an isometric view, illustrating a fully assembled ladder safety device 101 of ladder safety system 100, according to the preferred embodiment of FIG. 1. FIG. 3B shows another isometric view, illustrating the opposing view of the fully assembled ladder safety device 101 of ladder safety system 100, according to the preferred embodiment of FIG. 3A.

Ladder safety system 100 preferably comprises ladder safety device 101, preferably configured to allow assembly and disassembly by a user. Ladder safety device 101 preferably is comprised of metallic material, preferably aluminum, alternately preferably titanium, alternately preferably steel, preferably having anti-corrosive properties, such as, for example, stainless steel, or zinc-coated steel. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, carbon-fiber, plastics, wood, composite materials, other metals, etc., may suffice.

Figure 5:
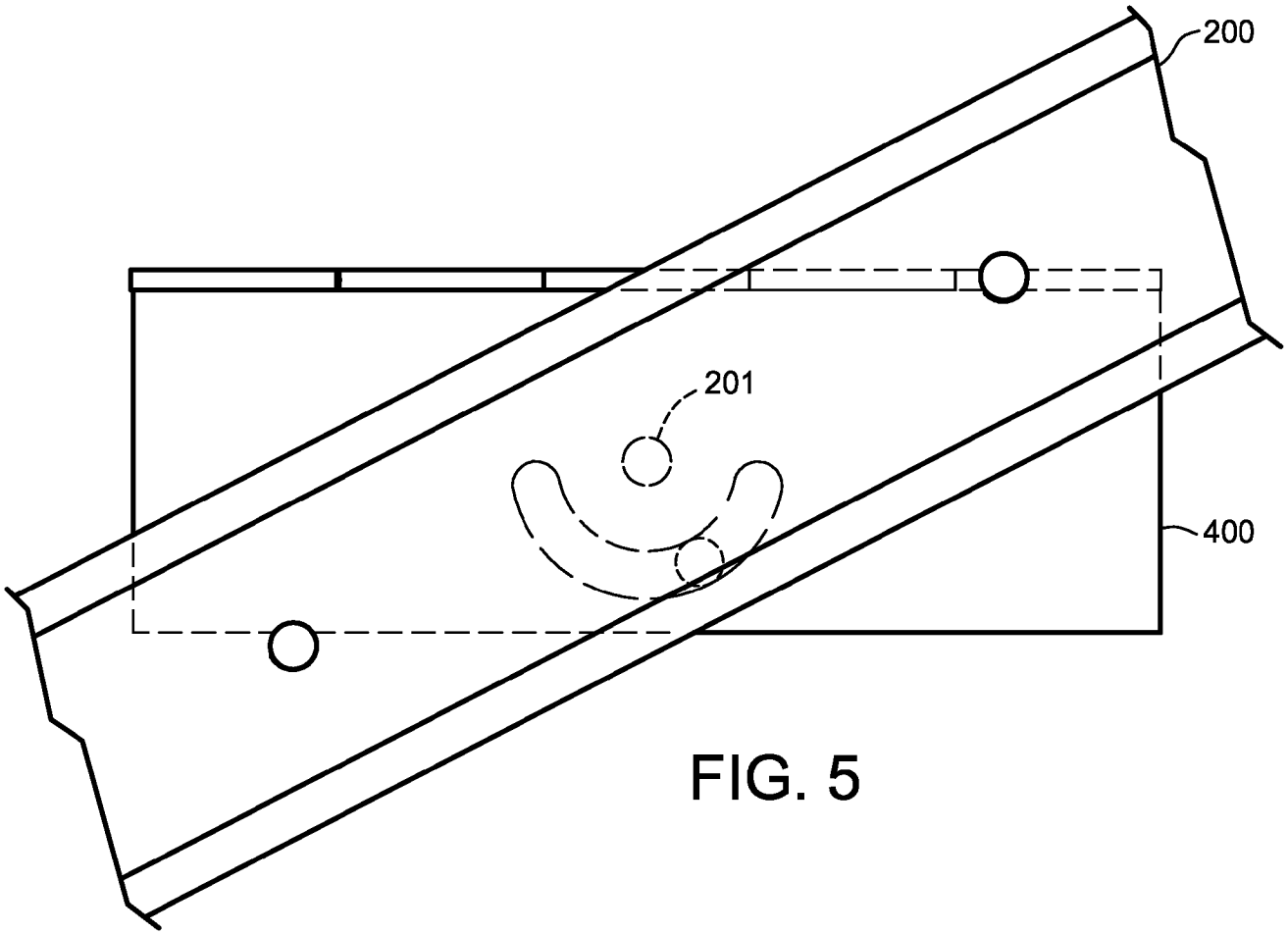
FIG. 5 shows a rear view, illustrating angle accommodator rotation of the ladder safety device of the ladder safety system, according to the preferred embodiment of FIG. 4.

Ladder safety device 101 preferably comprises rung engager 200 and jaw 300. Rung engager 200 (at least embodying herein ladder rung mount means for mounting to at least one ladder rung; and, at least embodying herein at least one ladder rung mount structured and arranged to mount to the at least one ladder rung) preferably engages at least one rung 106, preferably top rung 112, of ladder 102, as best shown in FIG. 1. Jaw 300 (at least embodying herein support engager means for engaging to the at least one upward extending support; and, at least embodying herein at least one support engager structured and arranged to engage to the at least one elevated structural support) preferably adapts to and rigidly clasps support member 104 (FIG. 2) or bent upright support 116 (FIG. 1). Rung engager 200 and jaw 300 preferably rotate with respect to each other on a pivot point 201 (at least embodying herein wherein said rotator means comprises pivot means for pivoting said support engager means with respect to said ladder rung mount means), preferably providing an assister means by which ladder safety device 101 assists adapting to and clasping bent or curved support structures, such as bent upright support 116 (as best shown in FIG. 1 and FIG. 5).

In preferred use, rung engager 200 is fixed parallel to at least one rung 106, preferably top rung 112; and, jaw 300 preferably may be rotated with respect to fixed rung engager 200 to adjust the angle of rotation to more closely match the curvature of a bent upright support 116, alternately preferably a non-vertical support (see details below), and assist clasping onto such bent upright support 116, as shown.

Alternately preferably, rung engager 200 and column jaw 300 are rotatable with respect to each other to adjust the angle of rotation of jaw 300 (this arrangement at least embodies herein wherein said support engager means comprises angle accommodator means for accommodating variable angles of the at least one upward extending support; and, this arrangement at least embodies herein wherein said at least one support engager comprises at least one angle accommodator structured and arranged to accommodate a plurality of angle geometries of the at least one elevated structural support) to more closely match almost any curvature between, and including vertical and horizontal, while leaving the rung engager 200 situate for about vertical ladder climbing by a user (at least embodying herein wherein the at least one ladder may be clasped to a plurality of angular geometries of the at least one elevated structural support). Upon reading this specification, those with ordinary skill in the art will now appreciate that, under appropriate circumstances, considering such issues as design preference, user preferences, marketing preferences, cost, structural requirements, available materials, technological advances, etc., other angle arrangements such as, for example, tilted, multiple axis rotated, multiple rung attackers with slightly different angular clasping, etc., may suffice.

Preferably, ladder safety device 101 is either pre-assembled onto a ladder, or assembled by at least one user upon ladder use, at which time the user preferably adjusts the dimensions of ladder safety system 100 in order to adapt to variable widths X and depths Y of the support member 104, as shown in FIG. 3B (see below).

Preferably, rung mounting plate 202 and rung cover panel 204 are assembled upon use of ladder safety device 101 around at least one ladder rung 106, preferably top rung 112 of ladder 102, to form rung engager 200, as shown. Assembled rung engager 200 preferably comprises rung cavity 295 which is preferably structured and arranged to accept at least one size of ladder rung 106, preferably top rung 112 of ladder 102 (as best shown in FIG. 1 and FIG. 3). Preferably, rung cavity 295 (at least embodying herein wherein said rung engager means and said rung cover means each comprise receiver means for receiving said such at least one ladder rung) may be sized to fit a plurality of ladder-sized rungs. Preferably, rung cavity 295 of rung mounting plate 202 contacts bottom surface 214 of ladder top rung 112 (see FIG. 2) (this arrangement at least embodies herein rung engager means for engaging the bottom surface of at least one ladder rung), and rung cover panel 204 contacts top surface 215 of ladder top rung 112 (see FIG. 2) (this arrangement at least embodies herein rung cover means for covering the top surface of said at least one ladder rung) in use (see FIG. 2) so as to capture and couple with ladder top rung 112.

Preferably, rung cover panel 204 is assembled with rung mounting plate 202 with apertures 205, 206, and 207 of both rung cover panel 204 and rung mounting plate 202 fully aligned (as best shown in FIG. 3A) so as to couple to ladder top rung 112, as shown (this arrangement at least embodies herein coupler means for coupling said rung engager means to said rung cover means). Rung engager 200 preferably is assembled by fastening rung mounting plate 202 to rung cover panel 204, preferably by placing at least three bolts 208, preferably threaded as shown, through each respective apertures 205, 206, and 207 (as best shown in FIG. 3A and FIG. 3B). Bolts 208 preferably comprise wing nuts 209 and preferably are secured together for completed installation, as shown in FIG. 3A. Rung mounting plate 202 and rung cover panel 204 preferably are also further engaged with at least one piano hinge 212, as shown. Piano hinge 212 preferably assists in easier installation onto a ladder rung by reducing the amount of assembly required, as shown.

Alternately preferably, rung mounting plate 202 and rung cover panel 204 preferably may be joined by additional nuts and bolts, without the use of piano hinge 212. Upon reading this specification, those with ordinary skill in the art will now appreciate that, under appropriate circumstances, considering such issues as design preference, user preferences, marketing preferences, cost, structural requirements, available materials, technological advances, etc., other attachment arrangements such as, for example, multiple hinges, no hinges, other fasteners, permanent fastening (welding, etc.), etc., may suffice.

Preferably, jaw 300 acts as a support engager to engage the elevated structural support, preferably by clasping such structural support and, alternately preferably, by clamping onto such structural support. The above-described arrangement at least embodies herein wherein said support engager means comprises clasping means for clasping to the at least one upward extending support; and, at least embodies herein wherein said at least one support engager comprises at least one clasper structured and arranged to clasp to the at least one elevated structural support.

Further, jaw 300 preferably comprises width accommodation (at least embodying herein wherein said support engager means comprises width accommodator means for accommodating variable widths of the at least one upward extending support; and, at least embodying herein wherein said at least one support engager comprises at least one width accommodator structured and arranged to accommodate variable widths of the at least one elevated structural support). Further, jaw 300 preferably comprises depth accommodation (at least embodying herein wherein said at least one support engager comprises at least one depth accommodator structured and arranged to accommodate variable depths of the at least one elevated structural support; and, wherein said support engager means comprises depth accommodator means for accommodating variable depths of the at least one upward extending support). Width and depth accommodation by jaw 300 preferably occurs by assisting adjustable width and depth engaging of such structural support by a user, as shown.

Preferably, jaw 300 is coupled to rung engager 200 so as to allow jaw 300 to swivel as needed to accommodate such structural support, as shown.

Jaw 300 preferably is comprised of at least two opposed end brackets 301, preferably L-shaped brackets adjoined by a central plate assembly 400 and preferably comprising at least one left side bracket 302 and at least one right side bracket 303, as shown. Column jaw 300 preferably is comprised of at least two jaw extensions 500, as shown. Preferably, jaw extensions 500 are mirrored to each other and about symmetrical, as shown. Preferably, each jaw extension 500 engages a respective side panel 330 of a respective left side bracket 302 or right side bracket 303 (as best shown in FIGS. 3A and 3B). Jaw extension 500 preferably comprises upper guide 502 and lower guide 504 (see FIG. 8B) for assisting capture and securing of side panel 330 of left side bracket 302 and right side bracket 303 by preferably engaging a respective left side bracket 302 and right side bracket 303, and by preferably engaging top edge 315 and bottom edge 316 of each respective side panel 330 (see FIG. 9), as shown. Preferably, upper guide 502 and lower guide 504 assist lateral movement of jaw extension 500, preferably slidably, along left side bracket 302 and right side bracket 303; as well as assisting capture of left side bracket 302 and right side bracket 303 within a respective jaw extension 500, as shown. Upon reading this specification, those with ordinary skill in the art will now appreciate that, under appropriate circumstances, considering such issues as design preference, user preferences, marketing preferences, cost, structural requirements, available materials, technological advances, etc., other adjustment arrangements such as, for example, notched adjustment, extenders, snap-lock adjusters, non-sliding adjustment, friction-adjustment, etc., may suffice.

Figure 9:
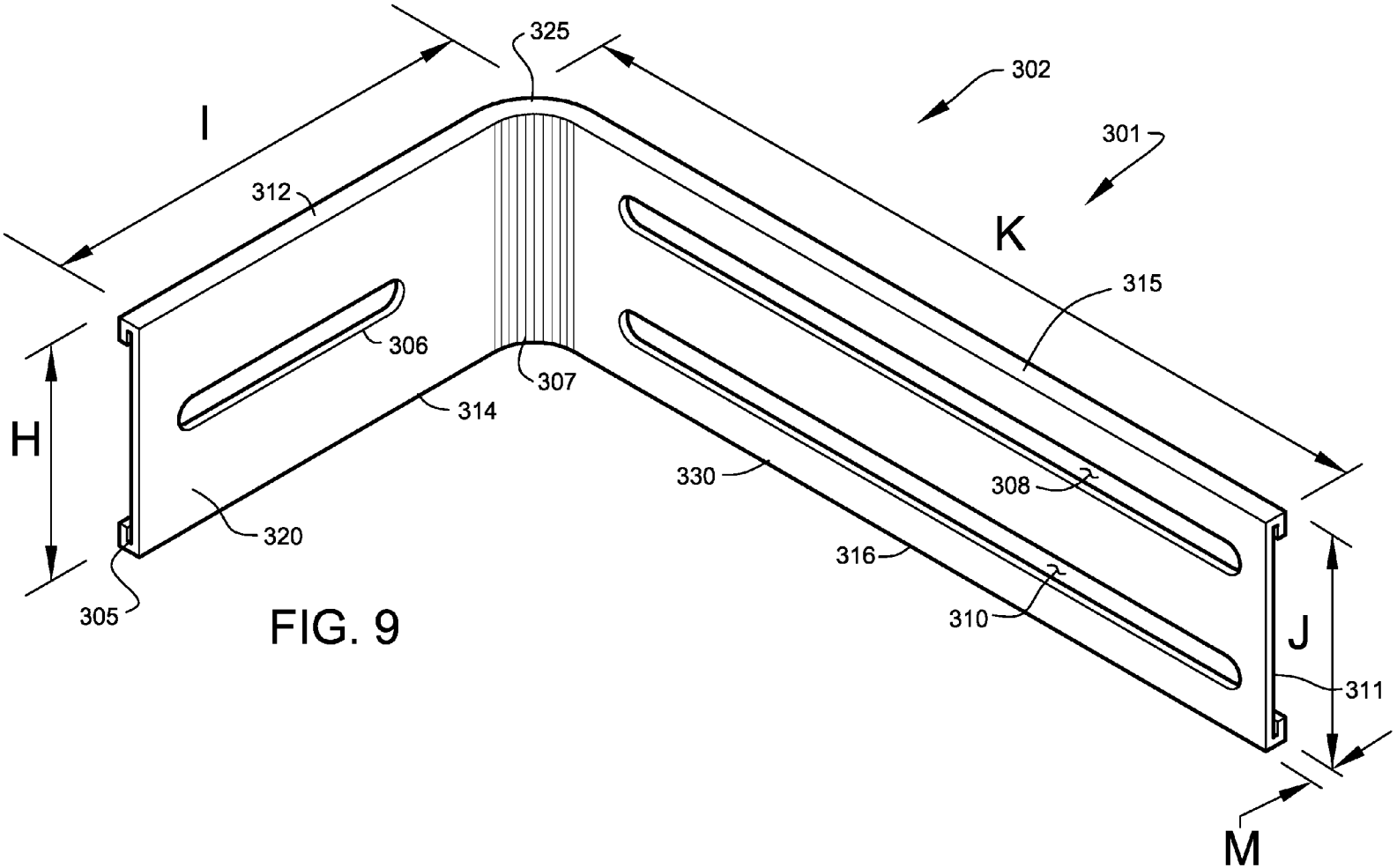
FIG. 9 shows an isometric view of a preferred left side bracket the ladder safety device of the ladder safety system, according to the preferred embodiment of FIG. 1.

Column jaw 300 preferably comprises at least one central plate assembly 400. Preferably, central plate assembly 400 allows the user to adjust the width X of column jaw 300 (see FIG. 3B), as well as the angle of rotation between rung engager 200 and column jaw 300 (see FIG. 2 and FIG. 4). Preferably, left side bracket 302 comprises at least one front panel 320 and at least one side panel 330, which preferably are oriented at about a ninety-degree angle with respect to one another, and preferably are connected by junction 325, preferably rounded and radiused, as shown in FIG. 3A, FIG. 3B, and FIG. 9.

Figure 4:
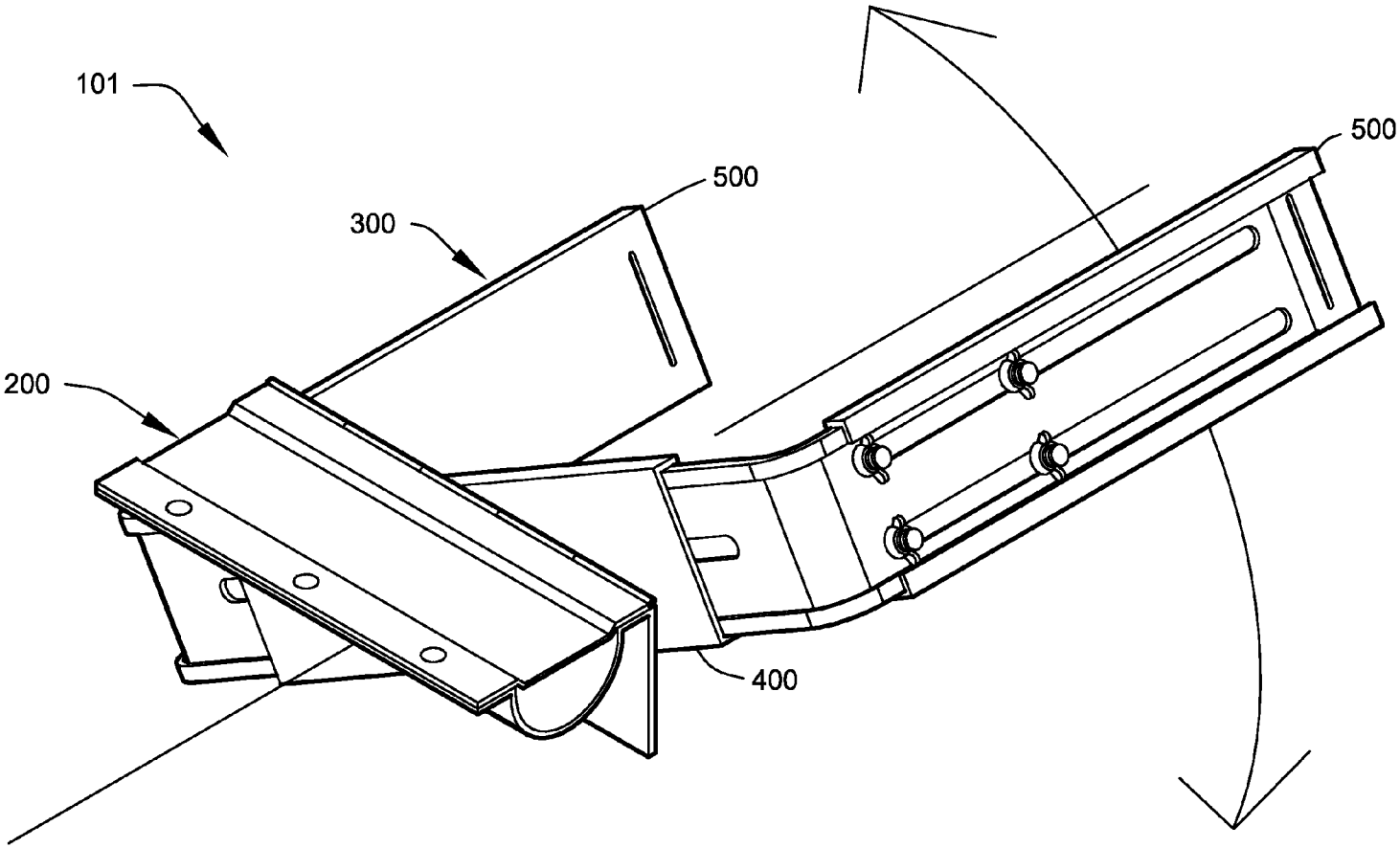
FIG. 4 shows an isometric view, illustrating the angle accommodator of the ladder safety device of the ladder safety system, according to the preferred embodiment of FIG. 1.
Figure 7A:
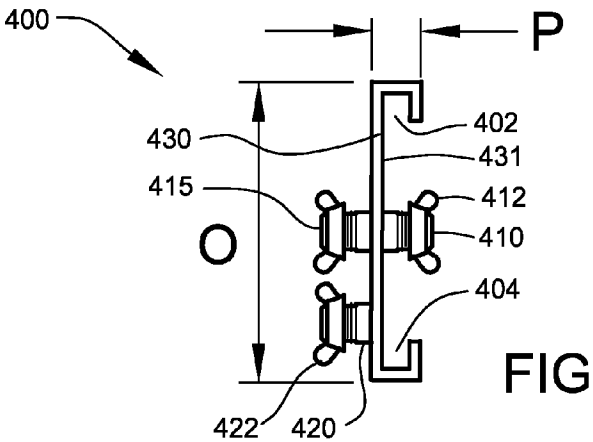
FIG. 7A shows a side view of a preferred central plate assembly of the ladder safety device of the ladder safety system, according to the preferred embodiment of FIG. 1.
Figure 7B:
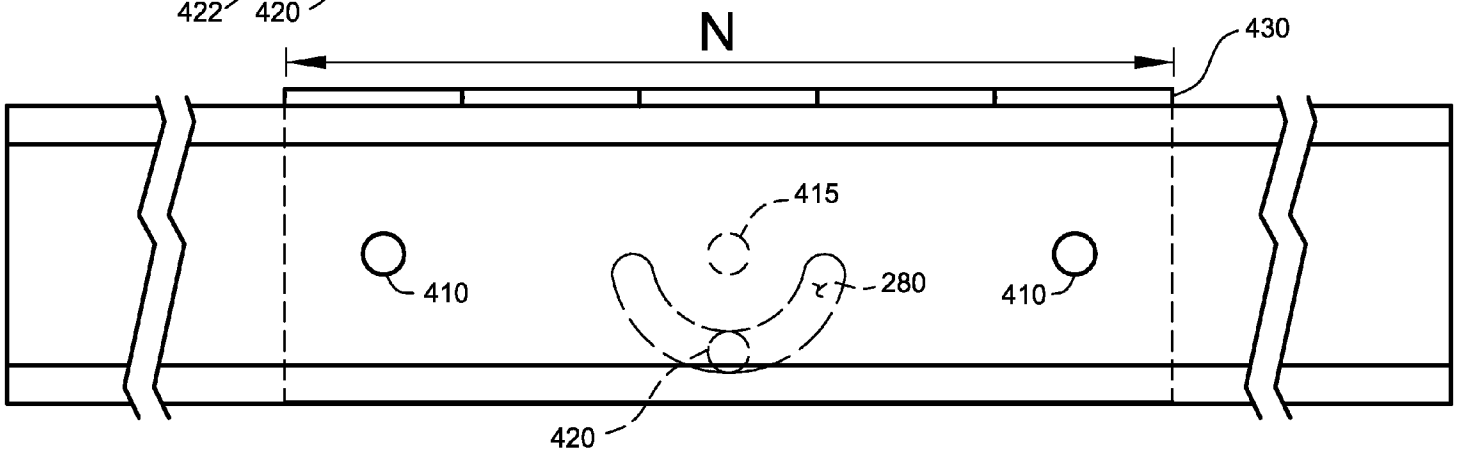
FIG. 7B shows a top view of a preferred central plate assembly of the ladder safety device of the ladder safety system, according to the preferred embodiment of FIG. 1.

FIG. 4 shows an isometric view, illustrating the angle accommodator of the ladder safety device 101 of the ladder safety system 100, according to the preferred embodiment of FIG. 1. FIG. 5 shows a rear view, illustrating angle accommodator rotation of ladder safety device 101 of ladder safety system 100, according to the preferred embodiment of FIG. 4. FIG. 7A shows a side view of a central plate assembly 400 of ladder safety device 101 of ladder safety system 100, according to the preferred embodiment of FIG. 1. FIG. 7B shows a top view of a preferred central plate assembly 400 of ladder safety device 101 of ladder safety system 100, according to the preferred embodiment of FIG. 1.

Preferably, central plate assembly 400 is about two hundred millimeters long, about seventy four millimeters wide, and about fifteen millimeters thick, as shown by dimensions N, 0, and P, respectively (see FIG. 7A and FIG. 7B). Preferably, central plate assembly 400 comprises upper guide 402 and lower guide 404 (as best shown in FIG. 7A), which preferably receive front panels 320 of both left side bracket 302 and right side bracket 303, by sliding over their top edge 312 and bottom edge 314 (see FIG. 9), respectively. Upper guide 402 and lower guide 404 of central plate assembly 400 preferably restrict up and down movement of left side bracket 302 and right side bracket 303, but preferably allow lateral movement of left side bracket 302 and right side bracket 303. Preferably, front panels 320 of left side brackets 302 and right side bracket 303 are slid laterally within upper guide 402 and lower guide 404 of central plate assembly 400 to form a tight fit around the perimeter of support member 104 or bent upright support 116, thereby preferably assisting user-fixing width X of column jaw 300 to match the width of support member 104 or bent upright support 116. Preferably, a range of widths X which can be accommodated by column jaw 300 are between about two hundred millimeters and about three hundred millimeters. Upon reading this specification, those with ordinary skill in the art will now appreciate that, under appropriate circumstances, considering such issues as design preference, user preferences, marketing preferences, cost, structural requirements, available materials, technological advances, etc., other measurement arrangements such as, for example, larger or smaller, etc., may suffice.

Preferably, the desired width X of column jaw 300 is lockable by user-fastening of at least two threaded bolts 410, which preferably are attached to central plate assembly 400 and then placed through transverse slots 306 of front panels 320 of left side bracket 302 and right side bracket 303 (best shown in FIG. 3B). Preferably, at least two butterfly nuts 412 are used to tighten threaded bolts 410 so as to allow width adjustment and then lock column jaw 300 in place, as shown. Preferably, threaded bolts 410 are tightened on back face 431 of central plate assembly 400. Preferably, threaded bolts 410 are about eight millimeter fixed bolts, and butterfly nuts 412 are eight millimeter butterfly nuts.

Preferably, central plate assembly 400 is aligned with jaw engage panel 270 of rung mounting plate 202, with front face 430 of central plate assembly 400 (see FIGS. 6B and 7A) contacting surface 290 of jaw engage panel 270. Preferably, when assembled with jaw engage panel 270, at least one central aperture 275 of jaw engage panel 270 preferably receives at least one threaded stud 415 (see FIG. 7A) which passes through jaw engage panel 270 and assists attaching central plate assembly 400 to it, as shown (this arrangement at least embodies herein connector means for connecting to said support engager means). Preferably, threaded stud 415 is tightened with at least one butterfly nut 412 preferably comprising at least one element by which the angle of rotation between rung engager 200 and column jaw 300 is fixed. This arrangement at least embodies herein angle accommodator means for accommodating variable angles of such at least one upward extending support.

Figure 6A:
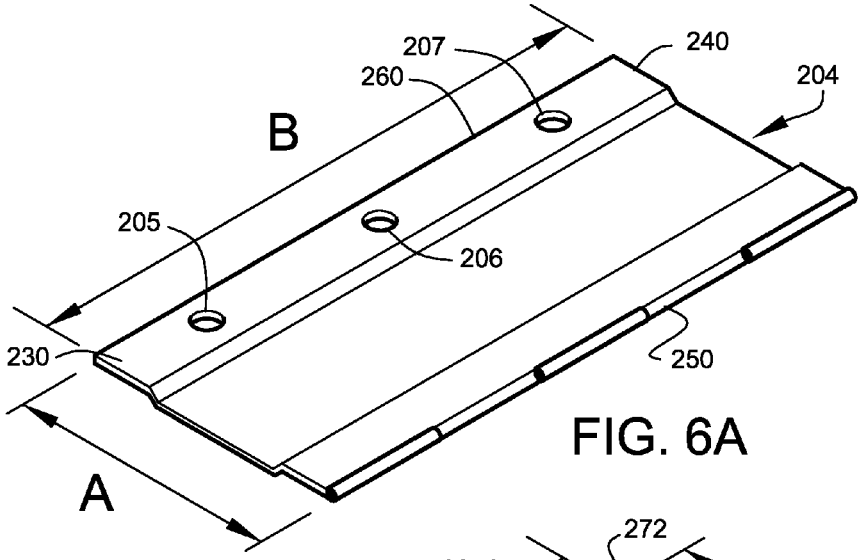
FIG. 6A shows an isometric view, illustrating a preferred rung cover panel component of the ladder safety device of the ladder safety system, according to the preferred embodiment of FIG. 3A.
Figure 6B:
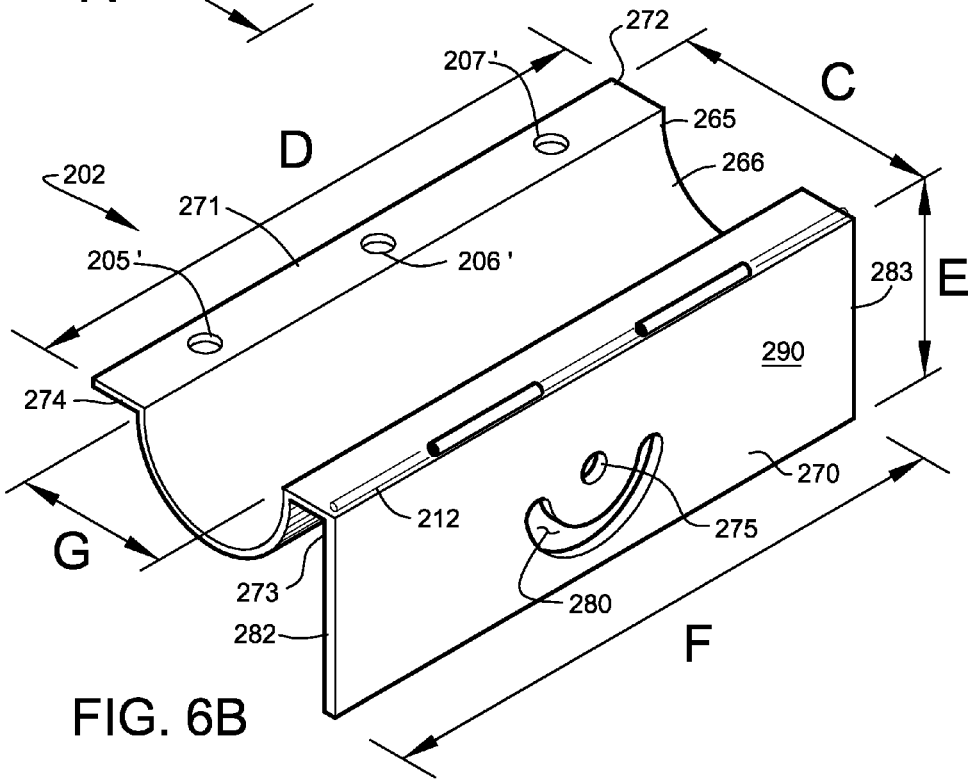
FIG. 6B shows an isometric view, illustrating a preferred rung mounting plate component of the ladder safety device of the ladder safety system, according to the preferred embodiment of FIG. 3A.

Central plate assembly 400 preferably comprises at least one threaded stud 420, which when assembled with jaw engage panel 270 of rung mounting plate 202 (see above), preferably inserts in arcuate slot 280 of jaw engage panel 270 (see FIG. 6B and FIG. 7B). Preferably, upon setting the desired angle of rotation between rung engager 200 and column jaw 300, at least one butterfly nut 422 preferably is used to tighten threaded stud 420, preferably providing an additional means by which the angle of rotation between rung engager 200 and column jaw 300 is fixed (at least embodying herein fixer means for fixing the angle of rotation of said support engager means with respect to said ladder rung mount means). Arcuate slot 280 (at least embodying herein wherein said rotator means comprises restrictor means for restricting the maximal angular displacement between said support engager means and said ladder rung mount means to about 90°) preferably functions as part of a swivel lock assembly which preferably limits the maximum angular displacement between rung engager 200 and column jaw 300 to about less than 360 degrees, preferably about ninety degrees to about 270 degrees, preferably 90 degrees. Upon reading this specification, those with ordinary skill in the art will now appreciate that, under appropriate circumstances, considering such issues as design preference, user preferences, marketing preferences, cost, structural requirements, available materials, technological advances, etc., other angular displacement arrangements such as, for example, for wider or smaller ranges, horizontal beam attachment, vertical-only structural attachment, etc., may suffice.

Preferably, in use, rung engager 200 is fixed parallel to the ground when anchored on at least one rung 106, preferably top rung 112 of ladder 102, and column jaw 300 is rotated with respect to rung engager 200 to accommodate curvature of bent upright support 116.

Figure 8A:
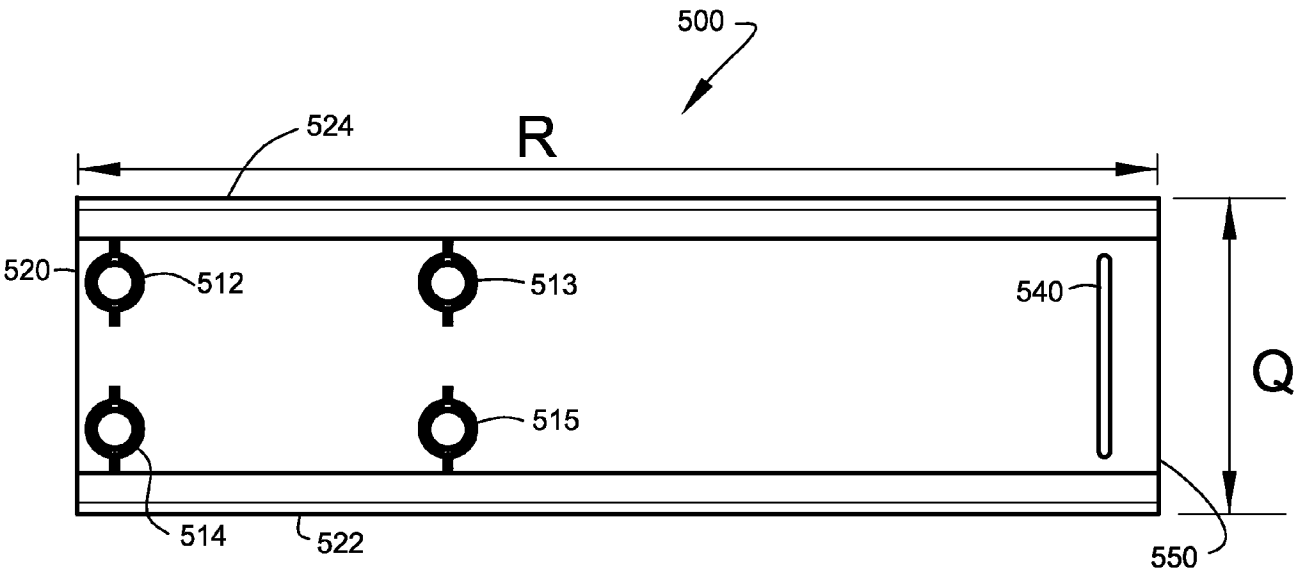
FIG. 8A shows a side view of a preferred jaw extension of the ladder safety device of the ladder safety system, according to the preferred embodiment of FIG. 1.
Figure 8B:
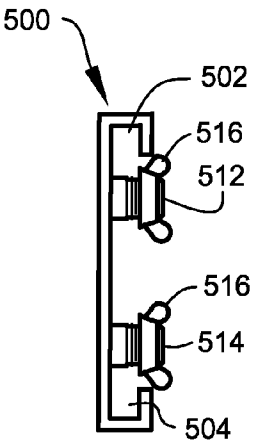
FIG. 8B shows a front view of a preferred jaw extension of the ladder safety device of the ladder safety system, according to the preferred embodiment of FIG. 1.

FIG. 8A shows a side view of a preferred jaw extension 500 of ladder safety device 101 of ladder safety system 100, according to the preferred embodiment of FIG. 1. FIG. 8B shows a front view of a preferred jaw extension 500 of ladder safety device 101 of ladder safety system 100, according to the preferred embodiment of FIG. 1. FIG. 9 shows an isometric view of a preferred left side bracket 302 ladder safety device 101 of ladder safety system 100, according to the preferred embodiment of FIG. 1.

Preferably, jaw extension 500 is about seventy-four millimeters wide and about one hundred and eighty-five millimeters long, as shown by dimensions Q and R, respectively (FIG. 8A). Preferably, each jaw extension 500 comprises at least four fasteners 512, 513, 514, and 515, (preferably, a nut and bolt combination as shown), two of which (fastener 512 and fastener 514) preferably are located about six and a half millimeters from front edge 520 of jaw extension 500, and two of which (fastener 513 and fastener 515) preferably are located about fifty-seven millimeters from front edge 520 of jaw extension 500. Preferably, fastener 512 and fastener 513 are located about eighteen and a half millimeters from top edge 524 of jaw extension 500, and fastener 514 and fastener 515 preferably are located about eighteen and a half inches from bottom edge 522 of jaw extension 500. Preferably, when jaw extension 500 is assembled with left side bracket 302 or right side bracket 303, fastener 512 and screw 513 fit within upper transverse slot 308 of side panel 330, and fastener 514 and fastener 515 fit within lower transverse slot 310 of side panel 330 (see FIG. 9).

Preferably, jaw extensions 500 preferably slide over bracket side panel 330 of left side bracket 302 and right side bracket 303, respectively, in order to fix depth Y to accommodate the depth of support member 104 or bent upright support 116 (see FIG. 1, FIG. 2, and FIG. 3B). Preferably, the desired depth Y of column jaw 300 is locked by fastening at least four fasteners 512, 513, 514, and 515 on each of the left and right sides of column jaw 300. When utilizing threaded bolts as shown, at least four butterfly nuts 516 (see FIG. 8B) on each of the left and right sides of column jaw 300 preferably are used to fasten fasteners 512, 513, 514, and 515, thereby preferably locking column jaw 300 in the desired width Y. Preferably, fasteners 512, 513, 514, and 515 are eight millimeter fixed threaded bolts, and butterfly nuts 516 preferably are eight millimeter threaded butterfly nuts. In another preferred embodiment of ladder safety system 100, an additional fastener is introduced on jaw extensions 500 to further fix width Y. Upon reading this specification, those with ordinary skill in the art will now appreciate that, under appropriate circumstances, considering such issues as design preference, user preferences, marketing preferences, cost, structural requirements, available materials, technological advances, etc., other fastener arrangements such as, for example, screws and nuts, rivets, bolts, bayonet fasteners, clasps, etc., may suffice.

Preferably, each jaw extension 500 comprises at least one strap coupler 543 (see FIG. 3A), preferably a vertical slot, for preferably receiving at least one strap 540 (at least embodying herein wherein said support engager means comprises strap means for strapping said support engager means to such at least one upward extending support) to further anchor ladder safety system 100 to support member 104 or bent upright support 116. Strap coupler 543 preferably is about forty millimeters long and about five millimeters wide, and is located about nine millimeters from back edge 550 of jaw extension 500, as shown in FIG. 3A. Those with ordinary skill in the art of using a strap will now appreciate that upon reading this specification and by their understanding the art of strap attachment as described herein, methods of cinching such strap will be understood by those knowledgeable in such art.

FIG. 6A shows an isometric view, illustrating a preferred rung cover panel 204 of ladder safety device 101 of ladder safety system 100, according to the preferred embodiment of FIG. 3A. FIG. 6B shows an isometric view, illustrating a preferred rung mounting plate 202 of ladder safety device 101 of ladder safety system 100, according to the preferred embodiment of FIG. 3A. Preferably, rung engager 200 is comprised of at least one rung mounting plate 202 and at least one rung cover panel 204, as shown. Rung cover panel 204 preferably is about seventy millimeters wide and about one hundred and fifty millimeters long, as shown by dimensions A and B, respectively. Rung panel 204 comprises at least three apertures 205, 206 and 207, as shown. Preferably, all apertures 205, 206, and 207 are located about sixty-two millimeters from back edge 250 of rung cover panel 204, and preferably are located about eight millimeters from front edge 260 of rung cover panel 204. Preferably, aperture 205 is located about twenty-five millimeters from right edge 230 of rung cover panel 204, and aperture 207 preferably is located about twenty-five millimeters from left edge 240. Preferably, aperture 205 and aperture 206 are spaced about fifty millimeters apart, and apertures 206 and aperture 207 preferably are spaced about fifty millimeters apart. Rung cover panel 204 preferably comprises piano hinge 212, which preferably is used to anchor rung cover panel 204 to rung mounting plate 202 (see below).

Rung mounting plate 202 preferably is comprised of rung under panel 265 and jaw engage panel 270, as shown. Preferably, rung under panel 265 and jaw engage panel 270 are oriented at a ninety degree angle with respect to one another at junction 273. Preferably, at least one piano hinge 212 is located at junction 273 between rung under panel 265 and jaw engage panel 270, as shown.

Rung under panel 265 preferably is about seventy millimeters wide and about one hundred and fifty millimeters long, as shown by dimensions C and D, respectively, thereby preferably approximating the dimensions of rung cover panel 204. Rung under panel 265 preferably comprises rung container 266 for preferably contacting the bottom surface of at least one rung 106, preferably bottom surface 114 of top rung 112 of ladder 102 (see FIG. 1). Preferably, rung container 266 begins about fifteen millimeters from front edge 271 of rung under panel 265, and ends about fifteen millimeters from junction 273. Preferably, rung container 266 has a diameter of about forty millimeters, as shown by dimension G in FIG. 6B.

Rung under panel 265 further preferably comprises at least three apertures 205', 206', and 207' which preferably are located about eight millimeters from front edge 271 of rung under panel 265. Aperture 205' preferably is located about twenty-five millimeters from right edge 274 of rung under panel 265, and aperture 207' is located about twenty-five millimeters from left edge 272. Preferably, aperture 205' and aperture 206' are spaced about fifty millimeters apart, and apertures 206' and aperture 207' preferably are spaced about fifty millimeters apart. Upon reading this specification, those with ordinary skill in the art will now appreciate that, under appropriate circumstances, considering such issues as design preference, user preferences, marketing preferences, cost, structural requirements, available materials, technological advances, etc., other apertures and spaced dimensions arrangements such as, for example, more or less apertures and/or larger or smaller dimensions, etc., may suffice.

Jaw engage panel 270 preferably is about seventy millimeters wide, and about one hundred and fifty millimeters long, as shown by dimensions E and F, respectively. Jaw engage panel 270 preferably comprises aperture 275 which preferably comprises the pivot point between rung engager 200 and column jaw 300. Preferably, aperture 275 is located in the center of jaw engage panel 270, as shown. More specifically, the center of aperture 275 preferably is located thirty-five millimeters from junction 273 between rung under panel 265 and jaw engage panel 270, about seventy-five millimeters from right edge 282 of jaw engage panel 270, and about seventy-five millimeters from left edge 283 of jaw engage panel 270. Aperture 275 preferably has an inner radius of about three and a half millimeters. Jaw engage panel 270 preferably comprises arcuate slot 280 which preferably performs as part of a swivel pivot lock assembly, which allows the user to adjust and set the degree of rotation between rung engager 200 and column jaw 300. Arcuate slot 280 preferably restricts the maximum angular displacement between rung engager 200 and column jaw 300 to about less than 360-degrees, preferably about ninety degrees to about 270-degrees, preferably 90-degrees. Upon reading this specification, those with ordinary skill in the art will now appreciate that, under appropriate circumstances, considering such issues as design preference, user preferences, marketing preferences, cost, structural requirements, available materials, technological advances, etc., other angular displacement arrangements such as, for example, for wider or smaller ranges, horizontal beam attachment, vertical-only structural attachment, etc., may suffice.

Preferably, both aperture 275 and arcuate slot 280 engage at least one mechanical fastener each, preferably at least one fixed screw and butterfly nut each, which enable the user to set the angel of rotation between rung engager 200 and column jaw 300.

FIG. 9 shows an isometric view of a preferred left side bracket 302 of ladder safety device 101 of ladder safety system 100, according to the preferred embodiment of FIG. 1. Preferably, left side bracket 302 comprises at least one front panel 320 and at least one side panel 330, which preferably are oriented at a ninety degree angle with respect to one another, and preferably are connected by junction 325, as shown. Front panel 320 preferably is about seventy millimeters wide and about ninety millimeters long, as shown by dimensions H and I, respectively. Front panel 320 preferably comprises transverse slot 306 which preferably is near the center of front panel 320, as shown. Transverse slot 306 preferably is located about thirty-one millimeters from top edge 312 of front panel 320, and about thirty-one millimeters from bottom edge 314 of front panel 320. Preferably, transverse slot 306 is about eight millimeters wide and about fifty-seven millimeters long. Preferably, transverse slot 306 begins about ten millimeters from right edge 305, and preferably ends about twenty three millimeters from left inner corner edge 307 of front panel 320.

Side panel 330 of left side bracket 302 preferably is about seventy millimeters wide and about one hundred and seventy four millimeters long, as shown by dimensions J and K, respectively.

Preferably, side panel 330 comprises at least one upper transverse slot 308, and at least one lower transverse slot 310, as shown. Upper transverse slot 308 and lower transverse slot 310 of side panel 330 preferably are both about eight millimeters wide and about one hundred and fifty seven millimeters long. Preferably, upper transverse slot 308 and lower transverse slot 310 are parallel to one another and preferably both begin about six and a half millimeters from back edge 311 of side panel 330. Preferably, upper transverse slot 308 is located about twelve and a half millimeters from top edge 315 of side panel 330, and lower transverse slot 310 preferably is located about twelve and a half millimeters from bottom edge 316 of side panel 330. Upper transverse slot 308 and lower transverse slot 310 are preferably spaced by about thirty millimeters. Preferably, left side bracket 302, including front panel 320, side panel 330, and junction 325, are about nine millimeters thick, as shown by dimension M.

Upon reading this specification, those with ordinary skill in the art will now appreciate that, under appropriate circumstances, considering such issues as design preference, user preferences, marketing preferences, cost, structural requirements, available materials, technological advances, etc., other dimension arrangements described above, such as, for example, greater or lesser dimensions, etc., may suffice.

Preferably, right side bracket 303 comprises all the features described herein for left side bracket 302, and is a mirror image of left side bracket 302.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to securing at least one ladder, having at least one ladder rung, to at least one elevated structural support, comprising:

a) at least one ladder rung mount structured and arranged to mount to the at least one ladder rung; and b) at least one support engager structured and arranged to engage to the at least one elevated structural support;

c) wherein said at least one support engager comprises at least one clasper structured and arranged to clasp to the at least one elevated structural support;

d) wherein said at least one support engager comprises at least one width accommodator structured and arranged to accommodate variable widths of the at least one elevated structural support;

e) wherein said at least one support engager comprises at least one depth accommodator structured and arranged to accommodate variable depths of the at least one elevated structural support; and f) wherein said at least one support engager comprises at least one angle accommodator structured and arranged to accommodate a plurality of angle geometries of the at least one elevated structural support;

g) wherein said at least one width accommodator is a separate structure from and adjustable independently from said at least one angle accommodator; and h) whereby the at least one ladder may be secured to elevated structural supports comprising a plurality of differing width, depth and angular geometries.

2. The system, according to claim 1, wherein:

a) the at least one ladder rung comprises at least one bottom portion and at least one upper foot-placement portion; and b) said at least one ladder rung mount comprises i) at least one rung engager structured and arranged to engage such at least one bottom portion of the at least one ladder rung, ii) at least one rung cover structured and arranged to cover such at least one upper foot-placement portion, and iii) at least one coupler structured and arranged to couple said at least one rung engager to said at least one rung cover;

c) wherein said at least one rung engager and said at least one rung cover each comprise at least one receiver structured and arranged to receive said at least one coupler; and d) at least one connector structured and arranged to connect said at least one ladder rung mount to said at least one support engager.

3. The system, according to claim 2, wherein said at least one rung engager and said at least one connector may be oriented from about a zero-degree to about a 90-degree angle with respect to one another.

4. The system, according to claim 2, wherein said at least one connector further comprises;

a) said at least one angle accommodator, and b) at least one rotator structured and arranged to rotate said at least one support engager with respect to said at least one ladder rung mount;

c) wherein said at least one rotator comprises at least one pivot structured and arranged to assist pivoting said at least one support engager with respect to said at least one ladder rung mount; and d) wherein said at least one rotator comprises at least one restrictor structured and arranged to restrict the maximal angular displacement between said at least one support engager and said at least one ladder rung mount; and e) at least one fixer structured and arranged to assist fixing the angle of rotation of said at least one support engager with respect to said at least one ladder rung mount.

5. The system, according to claim 1, wherein said at least one width accommodator comprises:

a) at least one guide structured and arranged to guide the lateral movement, of said at least one width accommodator; and b) at least one adjustable fixer structured and arranged to assist adjustably fixing such lateral movement;

c) wherein such width of said at least one width accommodator may be adjustably fixed.

6. The system, according to claim 5, wherein said at least one width accommodator limits range of widths of said at least one support engager from about two hundred millimeters to about three hundred millimeters.

7. The system, according to claim 1, wherein said at least one depth accommodator comprises:

a) at least one guide structured and arranged to guide the lateral movement of said at least one depth accommodator; and b) at least one adjustable fixer structured and arranged to assist adjustably fixing such lateral movement;

c) wherein such depth of said at least one depth accommodator may be adjustably fixed.

8. The system, according to claim 2, wherein said at least one angle accommodator comprises:

a) at least one coupler structured and arranged to couple to said at least one connector; and b) at least one rotator structured and arranged to rotate said at least one support engager with respect to said at least one ladder rung mount;

c) wherein said at least one rotator comprises art least one pivot structured and arranged to assist pivoting said at least one support engager with respect to said at least one ladder rung mount; and d) wherein said at least one rotator comprises at least one restrictor structured and arranged to restrict the maximal angular displacement between said at least one support engager and said ladder rung mount; and e) at least one adjustable fixer structured and arranged to assist adjustably fixing the angle of rotation of said at least one support engager with respect to said at least one ladder rung mount.

9. The system, according to claim 1, wherein said at least one support engager comprises at least one strap structured and arranged to assist strapping said at least one support engager to the at least one elevated structural support.

10. The system, according to claim 2, wherein said at least one rung cover comprises at least one hinge structured and arranged to hinge said at least one rung cover to said at least one rung engager.

11. The system, according to claim 8, wherein said at least one restrictor restricts the maximal angular displacement between said at least one support engager and said at least one ladder rung mount from about zero-degrees to about 90-degrees.

12. A system, relating to securing at least one ladder to at least one elevated structural support, comprising:

a) at least one ladder rung mount structured and arranged to mount to at least one ladder rung; and b) at least one support engager structured and arranged to engage to such at least one elevated structural support;

c) wherein said at least one support engager comprises at least one clamp structured and arranged to clamp to the at least one elevated structural support;

d) wherein said at least one support engager comprises at least one width accommodator structured and arranged to accommodate variable widths of the at least one elevated structural support;

e) wherein said at least one support engager comprises at least one depth accommodator structured and arranged to accommodate variable depths of the at least one elevated structural support;

f) wherein said at least one support engager comprises at least one rotator structured and arranged to rotate said at least one support engager with respect to said at least one ladder rung mount;

g) wherein said at least one width accommodator is a separate structure from and adjustable independently from said at least one rotator; and h) wherein the at least one ladder may be clamped to a plurality of width, depth and angular geometries of the at least one elevated structural support.

13. The system, according to claim 12, wherein:

a) said at least one rotator comprises at least one pivot structured and arranged to assist pivoting said at least one support engager with respect to said at least one ladder rung mount;

b) said at least one rotator comprises at least one restrictor structured and arranged to restrict the maximal angular displacement between said at least one support engager and said ladder rung mount;

c) said at least one restrictor restricts the maximal angular displacement between said at least one support engager and said at least one ladder rung mount from about zero-degrees to about 270-degrees; and said at least one rotator comprises at least one adjustable fixer structured and arranged to assist adjustably fixing the angle of rotation of said at least one support engager with respect to said at least one ladder rung mount.

14. A system, relating to securing at least one ladder, having at least one ladder rung, to at least one upward extending support, comprising:

a) ladder rung mount means for mounting to the at least one ladder rung; and)

b) support engager means for engaging to the at least one upward extending support;

c) wherein said support engager means comprises clasping means for clasping to the at least one upward extending support;

d) wherein said support engager means comprises width accommodator means for accommodating variable widths of the at least one upward extending support;

e) wherein said support engager means comprises depth accommodator means for accommodating variable depths of the at least one upward extending support;

f) wherein said support engager means comprises angle accommodator means for accommodating variable angles of the at least one upward extending support;

g) wherein said width accommodator means are separate structures from and adjustable independently from said at least one angle accommodator means; and h) wherein the at least one ladder may be clasped to a plurality of angular geometries of the at least one elevated structural support.

15. The system, according to claim 14, wherein said ladder rung mount means comprises:

a) rung engager means for engaging the bottom surface of the at least one ladder rung;

b) rung cover means for covering the top surface of the at least one ladder rung; and c) coupler means for coupling said rung engager means to said rung cover means;

d) wherein said rung engager means and said rung cover means each comprise receiver means for receiving the at least one ladder rung; and e) connector means for connecting to said support engager means.

16. The system, according to claim 15, wherein said connector means further comprises:

a) angle accommodator means for accommodating variable angles of the at least one upward extending support; and b) rotator means for rotating said support engager means with respect to said ladder rung mount means;

c) wherein said rotator means comprises pivot means for pivoting said support engager means with respect to said ladder rung mount means; and d) wherein said rotator means comprises restrictor means for restricting the maximal angular displacement between said support engager means and said ladder rung mount means to about 90°; and e) fixer means for fixing the angle of rotation of said support engager means with respect to said ladder rung mount means.

17. The system, according to claim 14, wherein said width accommodator means comprises:

a) guide means for guiding the lateral movement of said clasping means; and b) adjustable fixer means for adjustably fixing the width of said support engager means.

18. The system, according to claim 14, wherein said depth accommodator comprises:

a) guide means for guiding the lateral movement of said clamp means; and b) adjustable fixer means for adjustably fixing the depth of said support engager means.

19. The system, according to claim 14, wherein said angle accommodator means comprises:

a) coupler means for coupling to said connector means; and b) rotator means for rotating said support engager means with respect to said ladder rung mount means;

c) wherein said rotator means comprises pivot means for pivoting said support engager means with respect to said ladder rung engager means; and d) wherein said rotator means comprises restrictor means for restricting the maximal angular displacement between said support engager means and said ladder rung mount means to from about zero-degrees to about 270-degrees, and e) adjustable fixer means for adjustably fixing the angle of rotation of said support engager means with respect to said ladder rung mount means.

20. The system, according to claim 14, wherein said support engager means comprises strap means for strapping said support engager means to such at least one upward extending support.

* * * * *